US010243311B2

(12) United States Patent
Zhu et al.

(10) Patent No.: US 10,243,311 B2
(45) Date of Patent: Mar. 26, 2019

(54) ELECTRICAL CONNECTOR HOUSING ASSEMBLY AND ELECTRICAL CONNECTOR

(71) Applicants: TYCO ELECTRONICS (SHANGHAI) CO. LTD, Shanghai (CN); TYCO ELECTRONICS (SUZHOU) CO. LTD., Suzhou (CN); TYCO ELECTRONICS TECHNOLOGY (SIP) CO. LTD., Suzhou (CN)

(72) Inventors: Jlanghua Zhu, Suzhou (CN); Haomai Yin, Shanghai (CN); Suiya Wang, Suzhou (CN)

(73) Assignees: Tyco Electronics (Shanghai) Co. Ltd., Shanghai (CN); Tyco Electronics (Suzhou) Co. Ltd., Suzhou (CN); Tyco Electronics Technology (SIP) Co. Ltd., Suzhou (CN)

( * ) Notice: Subject to any disclaimer, the term of this patent is extended or adjusted under 35 U.S.C. 154(b) by 0 days.

(21) Appl. No.: 15/668,834

(22) Filed: Aug. 4, 2017

(65) Prior Publication Data

US 2018/0040996 A1 Feb. 8, 2018

(30) Foreign Application Priority Data

Aug. 5, 2016 (CN) ..... 2016 2 0845283 U

(51) Int. Cl.
*H01R 13/502* (2006.01)
*H01R 27/02* (2006.01)
(Continued)

(52) U.S. Cl.
CPC ..... *H01R 27/02* (2013.01); *H01R 12/69* (2013.01); *H01R 13/10* (2013.01); *H01R 13/631* (2013.01)

(58) Field of Classification Search
CPC ..... H01R 13/514
(Continued)

(56) References Cited

U.S. PATENT DOCUMENTS 5,458,511 A * 10/1995 Sasai ..... H01R 13/4368 403/326
9,368,883 B2 * 6/2016 Chiang ..... H01R 9/0506

* cited by examiner

*Primary Examiner* — Phuong Dinh
(74) *Attorney, Agent, or Firm* — Saxton & Stump, LLC

(57) ABSTRACT

The present application discloses an electrical connector housing assembly and an electrical connector. The electrical connector housing assembly comprises a housing provided with several plug-fitting holes for arranging plug-fitted terminals; and a rear-end cap detachably mounted at a rear end of the housing and covering part of the plug-fitting holes. The electrical connector comprises an electrical connector housing assembly and a plurality of inserted plug-fitted terminals. According to the electrical connector housing assembly of the present disclosure, by providing slots on hole walls among a row of plug-fitting holes wherein all slots forming a communicative elongated groove which may receive plug-fitted terminals of a wide-flat line body unbranched at a front end; by arranging the hole walls between plug-fitting holes to be thinned to receive plug-fitted terminals of a wide-flat line body branched at the front end; by plugging a plug-fitted terminal of a cylindrical line body structure into a single plug-fitting hole, the electrical connector housing assembly and the electrical connector of the present disclosure are enabled to be simultaneously adapted to three plug-fitted terminals of different line body structures.

21 Claims, 8 Drawing Sheets

(51) Int. Cl.
*H01R 13/10* (2006.01)
*H01R 13/631* (2006.01)
*H01R 12/69* (2011.01)

(58) Field of Classification Search
IPC ..... H01R 13/514,13/701, 13/752, 13/499
See application file for complete search history.

ELECTRICAL CONNECTOR HOUSING ASSEMBLY AND ELECTRICAL CONNECTOR

TECHNICAL FIELD

The present disclosure generally relates to an electrical connector, and more particularly to an electrical connector adapted for a variety of plug-fitted terminals.

BACKGROUND OF THE INVENTION

In the field of electrical connection, connecting lines of different line types are usually used for circuit connection. A traditional electrical connector socket can only be adapted to a plug-fitted terminal of one line type. If plug-fitted terminals of different line types are simultaneously used, electrical connectors with different sockets need to be installed in one electrical box, resulting in a complex structure and a poor adaptability.

SUMMARY OF THE INVENTION

An objective of the present invention is to provide an electrical connector housing assembly and an electrical connector to solve the above technical problems, which may simultaneously use at least two plugs of different line type structures.

According to one aspect of the present invention, there is provided an electrical connector housing assembly, comprising: a housing provided with several plug-fitting holes for arranging plug-fitted terminals; and a rear-end cap detachably mounted at a rear end of the housing and covering part (or all) of the plug-fitting holes.

In a preferable embodiment of the electrical connector housing assembly, hole walls are provided between adjacent plug-fitting holes; slots are provided on at least part of the hole walls, wherein all the slots form a communicative elongated groove for receiving connecting lines of the plug-fitted terminals.

In another preferable embodiment of the electrical connector housing assembly, hole walls are provided between adjacent plug-fitting holes wherein at least part of the hole walls are thinned for receiving branched connecting lines of the plug-fitted terminals.

In yet another preferable embodiment of the electrical connector housing assembly, the rear-end cap covers an outer side of the plug-fitting holes, for fixing and supporting the plug-fitted terminals. Preferably, an inner side of the rear-end cap is provided with one or more blocks which abut the plug-fitted terminals, such that the plug-fitted terminals cannot be withdrawn from the plug-fitting holes. More Preferably, the rear-end cap is provided with at least one groove through which the connecting lines of the plug-fitted terminals pass.

In another embodiment of the electrical connector housing assembly, a fixing structure is provided on the rear-end cap, to match a mating fixing structure provided on the housing and fix the rear-end cap onto the housing. Preferably, locking legs are provided at two ends of the rear-end cap, respectively, the housing is provided with retaining blocks, and the locking legs and the retaining blocks are snap-fitted to prevent the rear-end cap from falling off. More Preferably, reinforcing ribs are provided at an inner side of the locking legs at the two ends of the rear-end cap, for reinforcing the strength of the locking legs.

In some embodiments of the electrical connector housing assembly described above, there are a plurality of plug-fitting holes provided with the same structure for receiving plug-fitted terminals having the same connecting portion.

According to another aspect of the present invention, there further provided an electrical connector, comprising: the electrical connector housing assembly mentioned above; and a plug-fitted terminal that is plug-fitted into the plug-fitting hole.

In a preferable embodiment of the electrical connector, the plug-fitted terminal comprises a connecting line. Preferably, the connecting line has a wide-flat line body. More preferably, hole walls are provided between adjacent plug-fitting holes; slots are provided on at least part of the hole walls, wherein all slots form a communicative elongated groove; and the connecting line has a front end provided in the elongated groove. Even more preferably, the connecting line is an FFC wire.

In another preferable embodiment of the electrical connector, the connecting line has a cylindrical line body. Preferably, the rear-end cap is provided with at least one groove, wherein the connecting line passes through the slot.

In yet another preferable embodiment of the electrical connector, the plug-fitted terminal is provided with connection portions, and the connection portions are identical. Preferably, the plug-fitted terminals comprise a first connecting line and a second connecting line, wherein the first connecting line has a wide-flat line body; and the second connecting line has a cylindrical line body. More preferably, hole walls are provided between adjacent plug-fitting holes; slots are provided on at least part of the hole walls, wherein all the slots form a communicative elongated groove; and the first connecting line has a front end provided in the elongated groove.

In another more preferable embodiment of the electrical connector, the rear-end cap is provided with at least one groove, wherein the second connecting line passes through the slot.

According to the electrical connector housing assembly of the present disclosure, by providing slots on hole walls among a row of plug-fitting holes wherein all slots form a communicative elongated groove which may receive plug-fitted terminals of a wide-flat line body unbranched at a front end; by arranging the hole walls between plug-fitting holes to be thinned to receive plug-fitted terminals of a wide-flat line body branched at the front end; by plugging a plug-fitted terminal of a cylindrical line body structure into a single plug-fitting hole; by the plug-fitting holes in a row configured for inserting plug-fitted terminals of a wide-flat line body, the electrical connector housing assembly and the electrical connector of the present disclosure are enabled to be simultaneously adapted to three plug-fitted terminals of different line body structures.

BRIEF DESCRIPTION OF THE ACCOMPANYING DRAWINGS

DETAILED DESCRIPTION OF THE PREFERRED EMBODIMENTS

Figure 1A:
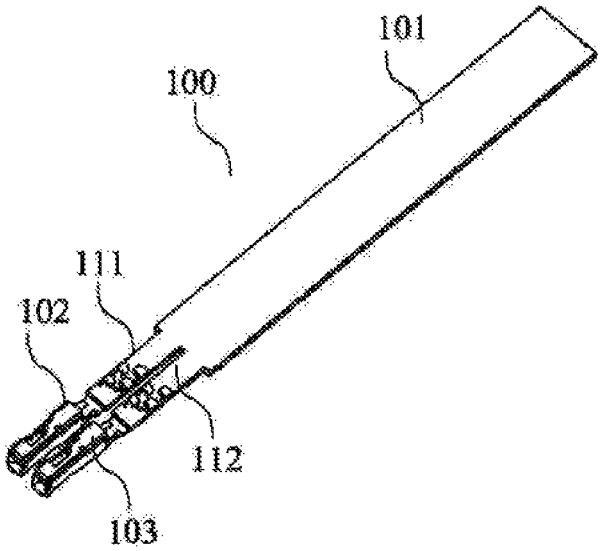
FIG. 1A is a structural diagram of a plug-fitted terminal of a wide-flat line body to which an electrical connector housing assembly of the present disclosure is adapted.

Hereinafter, various specific embodiments of the present disclosure will be described with reference to the accompanying drawings that constitute part of the specification. It should be noted that although the parts and components of various exemplary structures of the present disclosure are described using terms that indicate directions, such as "front," "rear," "up," "down," "left" and "right," the terms used herein are only for the convenience of illustration, which are determined based on the exemplary orientations shown in the drawings. Because the embodiments disclosed herein may be arranged according to different directions, such terms indicating directions are only illustrative and should not be regarded as limitations. In possible cases, the same or similar reference numerals used in the present disclosure refer to the same components.

Figure 1B:
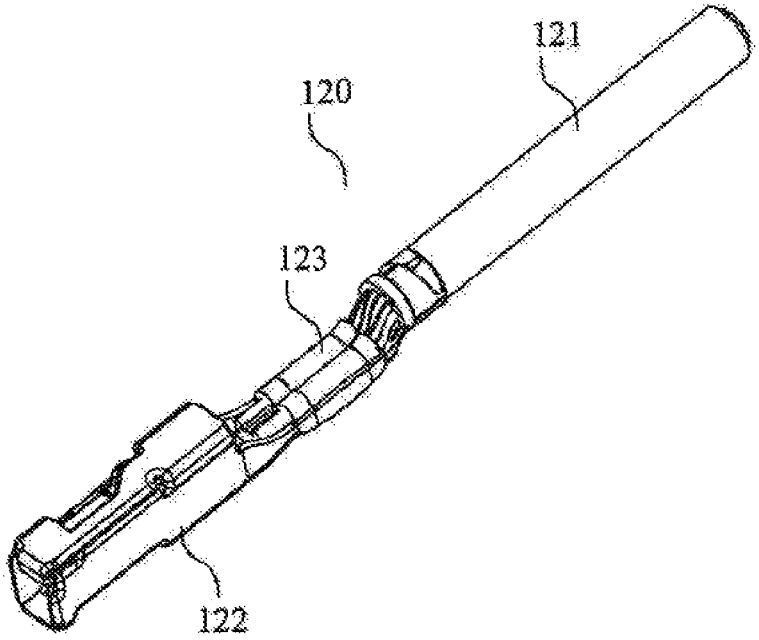
FIG. 1B is a structural diagram of a plug-fitted terminal of a cylindrical line body structure to which an electrical connector housing assembly of the present disclosure is adapted.
Figure 1C:
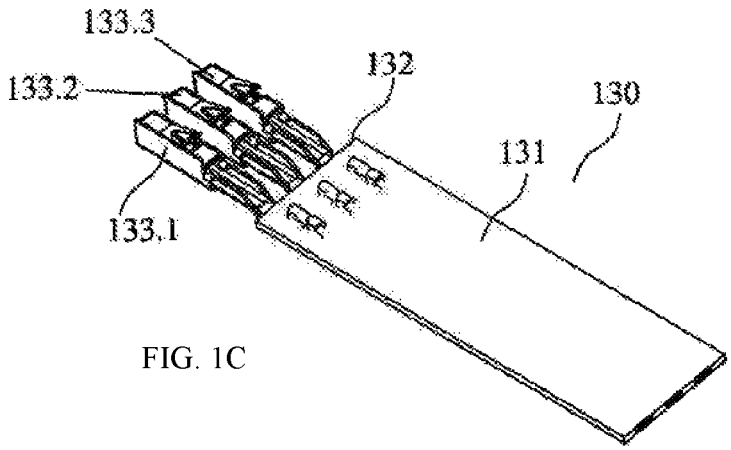
FIG. 1C is a structural diagram of a plug-fitted terminal of another wide-flat line body structure to which an electrical connector housing assembly of the present disclosure is adapted.

FIGS. 1A and 1B are structural diagrams of plug-fitted terminals of a first wide-flat line body structure and a cylindrical line body structure to which the electrical connector of the present disclosure is adapted; and FIG. 1C is a structural diagram of a plug-fitted terminal of another wide-flat line body structure to which the electrical connector of the present disclosure is adapted.

As shown in FIG. 1A, a plug-fitted terminal 100 of a wide-flat line body structure has connection portions 111.1 and 111.2 and a connecting line 101. In the illustrated example, the connecting line 101 has a wide-flat line body. According to a preferred embodiment of the present disclosure, the connecting line 101 is a flexible flat cable (FFC) or a flexible printed circuit board (FPC). The connecting line 101 is a wide-flat line body structure formed by a plurality of (bunches of) wires (two strands shown in FIG. 1A) pressed together. FIG. 1A shows that one line body is connected with two plugs 102 and 103 respectively by connection portions 111.1, 111.2 branched at a front end of the connecting line 101. In practice, by pressing multiple strands of wires together, a plurality of plugs may be connected simultaneously; these plugs need to be simultaneously plugged into the electrical connector.

The plug-fitted terminal 120 in FIG. 1B also has a connection portion 123 and a connecting line 121. In the illustrated example, the connecting line 121 is a cylindrical line body structure, and only one connecting line 121 is provided for each plug.

The plug-fitted terminal 130 in FIG. 1C also has a wide-flat line body structure, with a connecting line 131 being identical to that of the plug-fitted terminal 100, except that a front end connection portion 132 of the connecting line 131 is not branched when being connected with a plurality of plugs 133.1, 133.2, etc., but forms an integral structure where leads projecting out of an end portion of the connection portion 132 is directly connected with the plugs. Each connecting line 131 may be plug-fitted with a plurality of plugs 133.

Figure 2A:
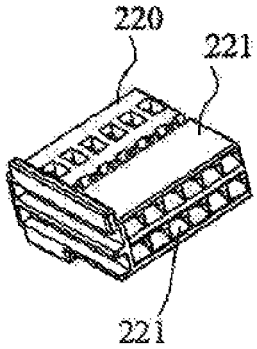
FIG. 2A is a structural diagram of an existing electrical connector housing assembly applicable to a plug-fitted terminal of a cylindrical line body structure.
Figure 2B:
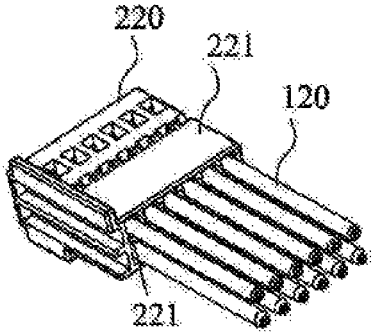
FIG. 2B is an assembled diagram of the electrical connector housing assembly of FIG. 2A after being assembled with the plug-fitted terminal.

FIG. 2A is a structural diagram of an existing electrical connector housing assembly applicable to a plug-fitted terminal of a cylindrical line body structure; FIG. 2B is an assembled diagram of the electrical connector housing assembly of FIG. 2A after being assembled with the plug-fitted terminal;

As shown in FIG. 2A, the electrical connector housing assembly 220 comprises a housing 201 formed with a receiving cavity, wherein an upper row of plug-fitting holes 221 and a lower row of plug-fitting holes 221 are formed at one side of the housing 201; the plugs 122 of the plug-fitted terminals 120 of FIG. 1B may be plug-fitted into the plug-fitting holes 221, respectively; i.e., as shown in FIG. 2B. the plug-fitting holes 211 are provided in two rows, each row having 6 plug-fitting holes, one plug-fitted terminal being plug-fitted into each plug-fitting hole, such that 12 plug-fitted terminals in total are plug-fitted into the two rows of plug-fitting holes, respectively.

Figure 3A:
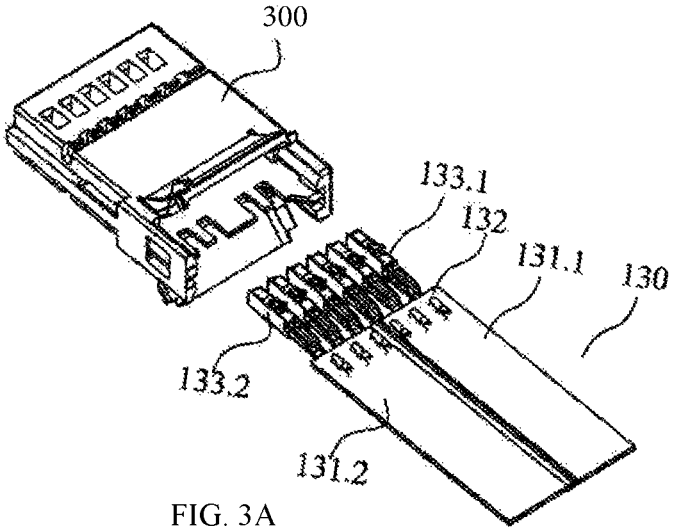
FIG. 3A is a structural diagram of an existing electrical connector applicable to a plug-fitted terminal of a wide-flat line body structure.
Figure 3B:
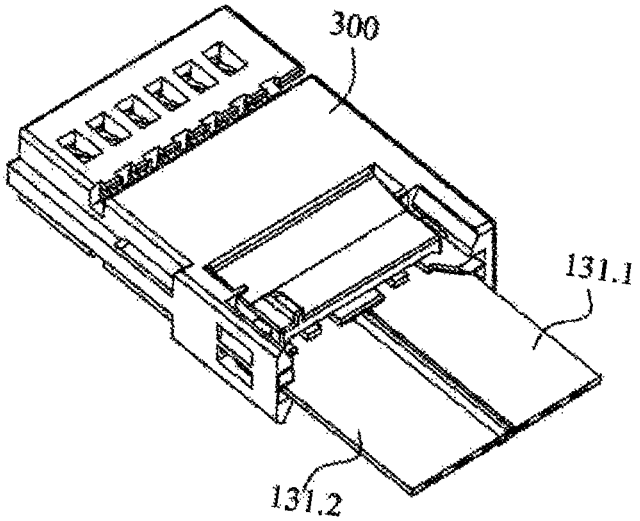
FIG. 3B is an assembled diagram of the electrical connector housing assembly of FIG. 3A after being assembled with the plug-fitted terminal.

FIG. 3A is a structural diagram of an existing electrical connector applicable to a plug-fitted terminal of a wide-flat line body structure; FIG. 3B is an assembled diagram of the electrical connector housing assembly of FIG. 3A after being assembled with the plug-fitted terminal.

As shown in FIG. 3A and FIG. 3B, the electrical connector housing assembly 300 is applicable to the plug-fitted terminal 130 of a wide-flat line body structure as shown in FIG. 1C, and the electrical connector housing assembly 300 in the figures may be available for inserting two three-pin plug-fitted terminals 130. The plug-fitting holes of the electrical connector housing assembly 300 have a communicative structure applicable to the line body 131 of the wide-flat line body structure of the plug-fitted terminals 100, 130. Actually, the plug-fitted terminal 130 of the wide-flat line body structure shown in FIG. 1A may also be plug-fitted.

Figure 4:
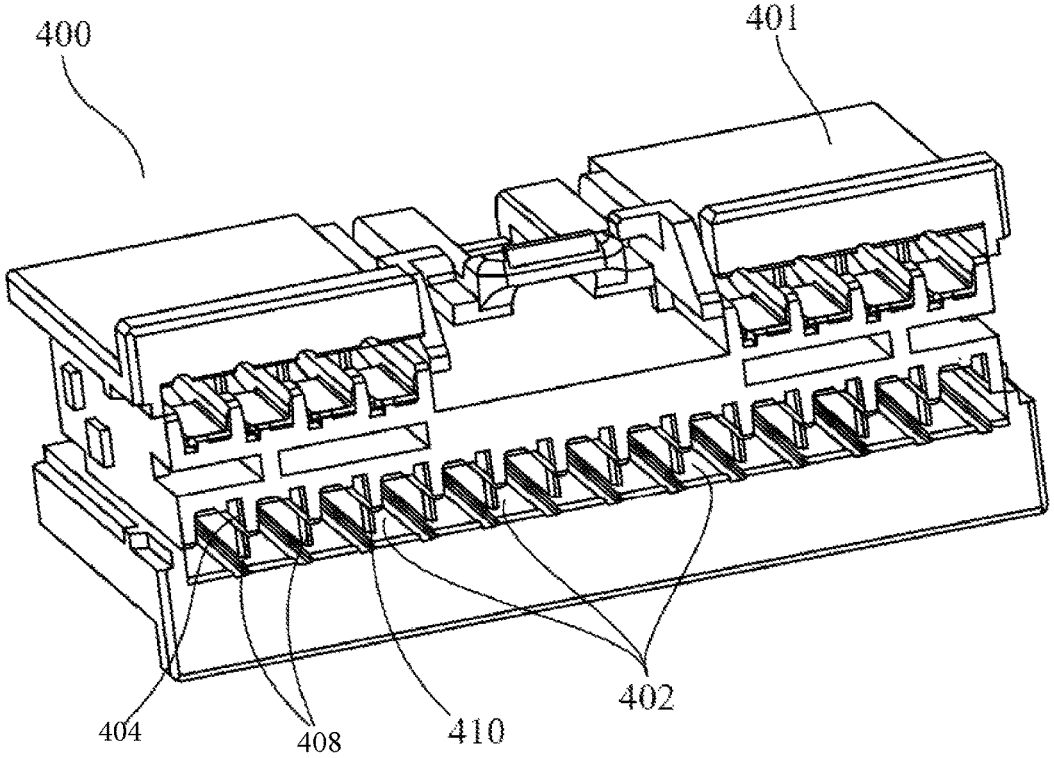
FIG. 4 is a structural stereoscopic diagram of an electrical connector housing assembly of the present disclosure.

However, the electrical connector housing assembly 220 shown in FIGS. 2A and 2B are not adaptable to the plug-fitted terminals 100 and 130 of a wide-flat line body structure; the electrical connector housing assembly 300 as shown in FIGS. 3A and 3B are not applicable to plug-fitted terminals 120 of a cylindrical line body structure; if three (or two) different plug-fitted terminals are plug-fitted simultaneously, a novel electrical connector housing assembly, as shown in FIG. 4, needs to be provided.

FIG. 4 is a structural stereoscopic diagram of an electrical connector housing assembly of the present disclosure.

As shown in FIG. 4, the electrical connector housing assembly 400 comprises a housing 401 formed with a receiving cavity, wherein a row of plug-fitting holes 402 are provided on a side of the housing 401, for plug-fitting the plug-fitted terminals 120 and 130 as mentioned above; the plug-fitted terminals (120, 130) are plug-fitted into the receiving cavity from the plug-fitting holes 402, so as to be mutually plug-fitted with a circuit inside the receiving cavity.

The plug-fitting holes 402 are adjacent to each other. Hole walls 404 are provided between neighboring plug-fitting holes 402. One plug-fitted terminal 120 of a cylindrical line body structure may be plug-fitted in each plug-fitting hole, but due to the block of the hole wall 404, the plug-fitted terminal 100 of a wide-flat line body structure cannot be plug-fitted. Therefore, slots 408 are provided on the hole walls 404 in the same row at the same height, wherein all slots 408 form a communicative elongated groove 410, and at this point, the plug-fitted terminal 130 of a wide-flat line body structure may be plug-fitted into the plug-fitting hole 402, and the elongated groove 410 may just receive the wide-flat line body 131 of the plug-fitted terminal 130. Now, two plug-fitted terminals 120 and 130 of different structures may be simultaneously plug-fitted into the electrical connector housing assembly 400. The specific scenario is shown in FIG. 5.

In addition, if the plug-fitting hole 402 needs to be plug-fitted with the plug-fitted terminal 100 of the wide-flat line body structure of FIG. 1A, because the plug-fitted terminal 100 has branched connection portions 111.1, 111.2, only the regions of the hole walls 404 in the same row in contact with the branched portions need to be thinned, and then the plug-fitted terminals 100 branched at the front end may be plug-fitted into the plug-fitted hole 402. For the convenience of illustration, this design is shown in the plug-fitting holes 410 provided on two sides of the upper portion of the electrical connector housing assembly 400. In the figure, a thinned hole wall is provided at a middle part of the hole wall 404 between adjacent plug-fitting holes 410 for facilitating the connection portions 111.1, 111.2 of the plug-fitted terminal 100 to be plug-fitted thereinto.

It is knowable that the thinned hole wall design of the plug-fitting hole 402 is adapted to the plug-fitted terminal 100 of a wide-flat line body structure branched at the front end, the plug-fitting hole 402 provided with an elongated groove 410 is adapted to the plug-fitted terminal 130 of an unbranched wide-flat line body structure, and a single plug-fitting hole 402.1 is adapted for plug-fitting a plug-fitted terminal 120 of a cylindrical line body structure. Actually, the plug-fitting hole 402 may also be provided with a thinned hole wall so as to adapt the plug-fitted terminal 100 of a wide-flat line body structure branched at the front end, as shown in FIG. 7C.

Figure 5:
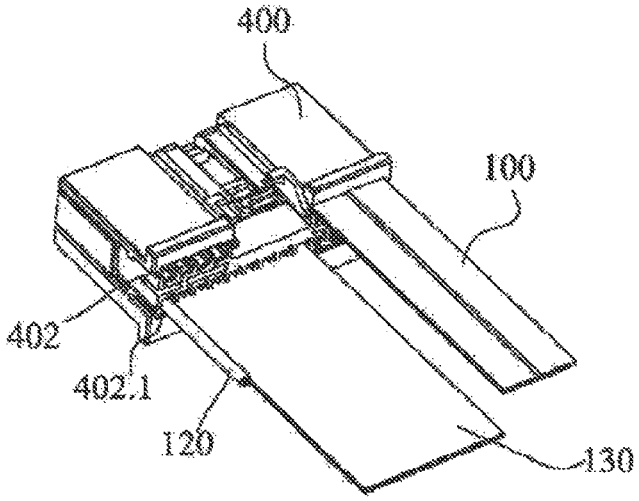
FIG. 5 is a structural stereoscopic diagram of an electrical connector housing assembly of the present disclosure plug-fitted with three plug-fitted terminals of different line types (without mounting a rear-end cap)

FIG. 5 is a structural stereoscopic diagram of an electrical connector housing assembly of the present disclosure plug-fitted with three plug-fitted terminals of different line types (without mounting a rear-end cap).

As shown in FIG. 5, a plurality of plug-fitted terminals 130 of the wide-flat line body structure are plug-fitted into the plug-fitting hole 402 of the electrical connector housing assembly 400. The plug-fitted terminal 120 of a cylindrical line body structure is plug-fitted into the plug-fitting hole 402.1 at the left lower corner in the figure, enabling simultaneous plug-fitting of the plug-fitted terminals of different line types. Two plug-fitted terminals 100 of a wide-flat line body structure are plug-fitted into the plug-fitting hole 420 at the right upper corner of the electrical connector housing assembly 400.

Figure 6A:
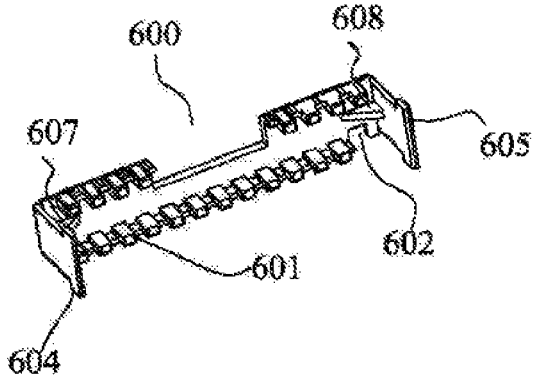
FIGS. 6A, 6B are structural stereoscopic diagrams of front and back sides of a rear-end cap of an electrical connector housing assembly of the present disclosure, respectively.
Figure 6B:
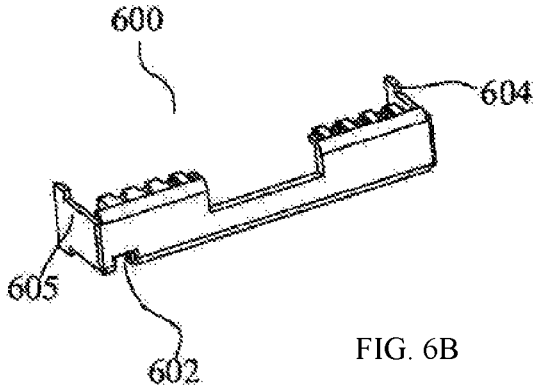

FIGS. 6A, 6B are structural stereoscopic diagrams of the front and back of a rear-end cap of an electrical connector of the present disclosure, respectively.

The electrical connector housing assembly 400 further comprises a rear-end cap 600. After the plug-fitted terminals 120, 130 are plug-fitted into the electrical connector housing assembly 400, the electrical connector housing assembly 400 needs to be encapsulated, and meanwhile, the plug-fitted terminals are fixed onto the electrical connector housing assembly 400. The present disclosure further provides a rear-end cap 600 as shown in FIGS. 6A and 6B. FIGS. 6A and 6B show the front and back stereoscopic diagrams of the rear-end cap.

The rear-end cap covers the side of the housing 401 on which is provided with the plug-fitting holes 402, for reinforcing the plug-fitted terminals 120, 130.

It is knowable from FIG. 6A that the shape of an inner side of the rear-end cap 600 is adapted to that of the plug-fitting hole 402 after being plug-fitted with a plug-fitted terminal; two rows of blocks 601 are provided on the inner side of the rear-end cap 600; the blocks 601 may be plug-fitted into an interstice left after the plug-fitted terminals 120, 130 are plug-fitted into the plug-fitting holes 402, such that the plug-fitted terminals 120, 130 cannot loosen up from the plug-fitting hole 402.

Two ends of the rear-end cap 600 are provided with a locking leg 604 and a locking leg 605, respectively; reinforcing ribs 607 and 608 are provided on an inner side of the locking leg 604 and the locking leg 605 at two ends of the rear-end cap 600, for reinforcing the strength of the locking leg 604 and the locking leg 605.

As shown in FIG. 6B, the rear-end cap 600 is further provided a groove 602 based on the position of the plug-fitted terminal 120 of a cylindrical line body structure, such that the cylindrical line body 121 of the plug-fitted terminal 120 of the cylindrical line body structure passes through the groove 602.

Figure 7A:
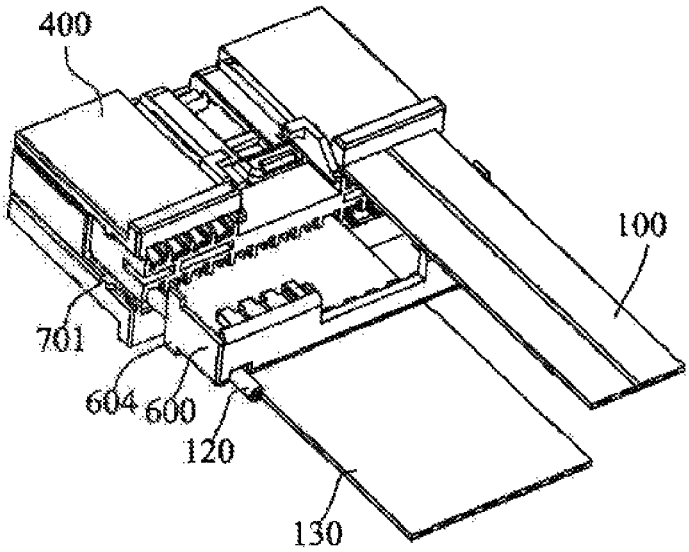
FIG. 7A is a partial exploded stereoscopic diagram of an electrical connector housing assembly of the present disclosure plug-fitted with three plug-fitted terminals of different line types.
Figure 7B:
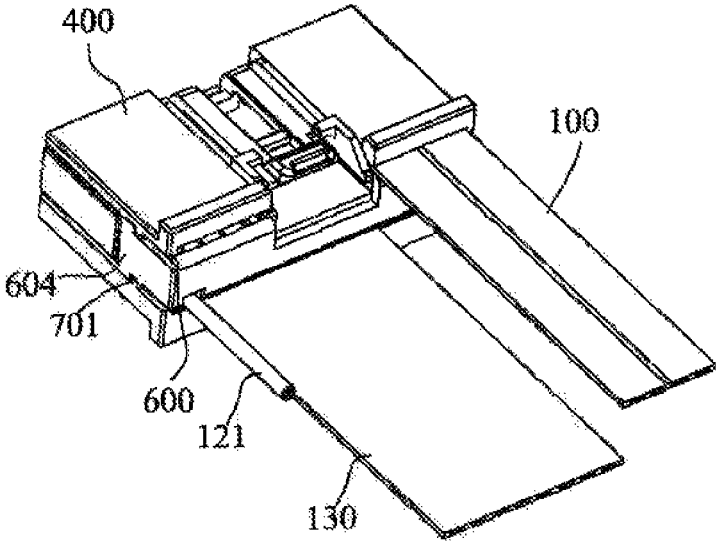
FIG. 7B is a structural stereoscopic diagram of the assembled electrical connector of FIG. 7A.
Figure 7C:
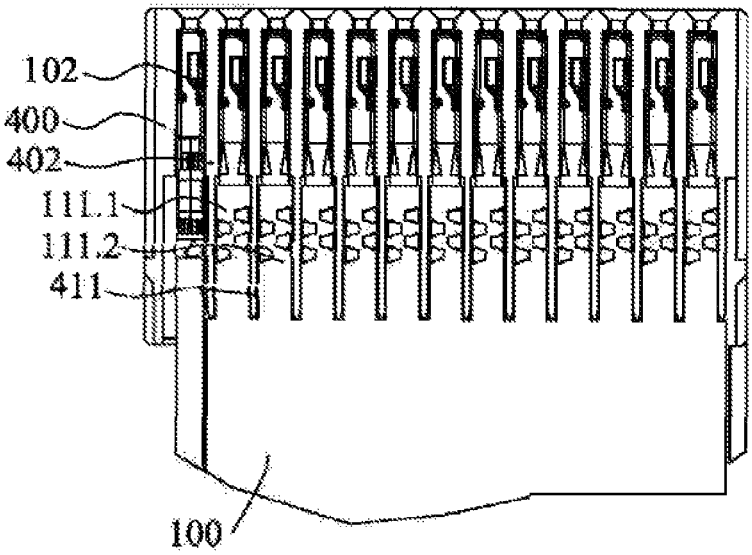
FIG. 7C is a sectional view along line A-A after a plug-fitted terminal is plug-fitted into a plug-fitting hole of the electrical connector housing assembly of FIG. 7B.
Figure 7D:
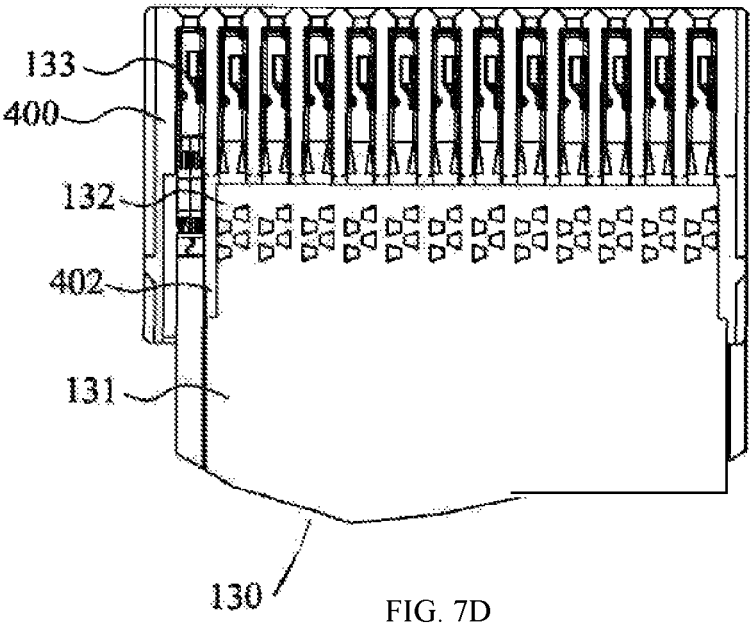
FIG. 7D is a sectional view of the electrical connector of FIG. 7B along line B-B.

FIG. 7A is a partial exploded stereoscopic diagram of an electrical connector housing assembly of the present disclosure plug-fitted with three plug-fitted terminals of different line types; FIG. 7B is a structural stereoscopic diagram after various components of FIG. 7A are completely assembled.

As shown in FIG. 7A, a retaining block 701 is provided on two sides (the other side not shown) of the housing 401 of the electrical connector housing assembly 400, respectively; the locking legs 604 and 605 of the rear-end cap 600 may be snap-fitted into the retaining block 701 to prevent the rear-end cap from falling off, and thereby securely fix the rear-end cap onto the housing 401.

As illustrated in FIGS. 7A and 7B, the position covered by the rear-end cap 600 is the space left after the plug-fitted terminal 120 and the plug-fitted terminal 130 are plug-fitted on one side of the housing 401. The rear-end cap 600 provides support to the connecting lines 131 and 121 of a flat line body, to prevent transient interruption of connection signals of the terminals 102, 103 caused when the connecting lines 131 and 121 swinging on the main surface vertical to the connecting lines, i.e., swinging or vibrating along a vertical direction in the figures, and avoid the impact on 120, 130 in signal transmission due to the excessive swing of 101.

As an example, in the present disclosure, only a plug-fitted terminal 120 of the second connecting line 121 with a cylindrical line body is plug-fitted into the lower left corner of the electrical connector housing assembly 400, and the groove 602 of the rear-end cap 600 is also correspondingly disposed at a position where the wire of the plug-fitted terminal 120 is led out. Actually, the plug-fitted terminal 120 of the cylindrical line body structure may be designed at different positions of the plug-fitting hole 402 according to needs, and the number thereof is not limited to one; besides, the number and position of the grooves 602 on the rear-end cap 600 may also be adapted.

FIG. 7C is a sectional view along line A-A after a plug-fitted terminal 100 is plug-fitted into a plug-fitting hole 402 of the electrical connector housing assembly 400 of FIG. 7B; FIG. 7C is a sectional view along line A-A after a plug-fitted terminal 130 is plug-fitted into a plug-fitting hole 402 of the electrical connector housing assembly 400 of FIG. 7B.

In FIG. 7C, it is knowable that the plug-fitting hole 402 is provided with a thinned hole wall 411, and the connection portions 111.1, 111.2 of the plug-fitted terminal 100 are branched, such that the thinned hole wall 411 is exactly plug-fitted into the branches of the connection portions 111.1, 111.2.

In FIG. 7C, the hole walls 411 of the plug-fitting holes 402 are provided with slots 408 which form a communicative elongated groove 410, and a front end portion 132 of the plug-fitted terminal 130 is entirely plug-fitted into the elongated groove 410.

Figure 7E:
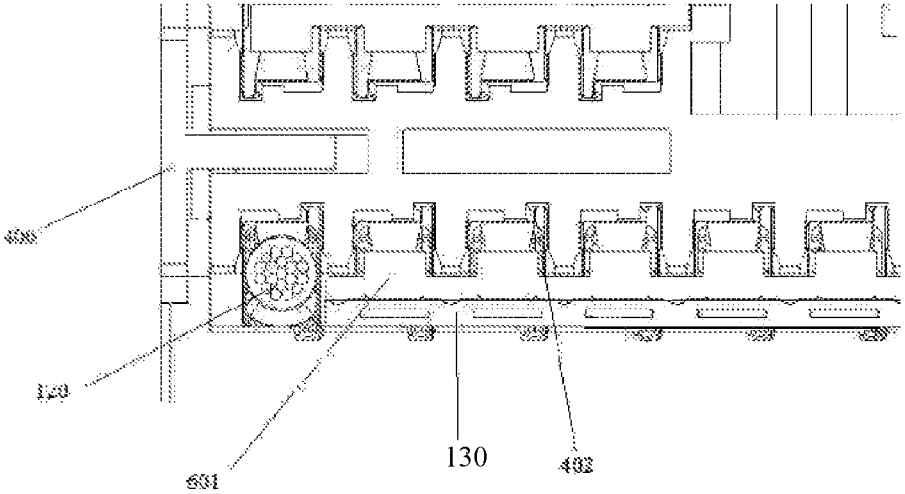
FIG. 7E is a sectional view of the electrical connector housing assembly of FIG. 7B along line B-B.

FIG. 7E is a sectional view of the electrical connector housing assembly of FIG. 7B along line B-B.

In the sectional view of FIG. 7E, a block 601 of the rear-end cap 600 is plug-fitted into an interstice left after the plug-fitted terminal 130 is plug-fitted into the plug-fitting hole 402, such that the plug-fitted terminal 130 cannot loosen up from the plug-fitting hole 402.

Although the present disclosure has been described with reference to the specific embodiments shown in the drawings, it should be understood that without departing from the spirit, scope, and background of the present disclosure, the electrical connector of the present disclosure may have many variations, e.g., positions for disposing the plug-fitted terminals of a cylindrical line body structure and a wide-flat line body structure, etc. A person of normal skill in the art will also appreciate that the parameters in the embodiments disclosed by the present disclosure may be varied in different ways, which all fall within the spirit and scope of the appended claims and the present disclosure.

What is claimed is:

1. An electrical connector housing assembly, comprising:

a housing formed with a plurality of plug-fitting holes for supporting plug-fitted terminals, hole walls provided between adjacent plug-fitting holes, slots are formed on at least part of the hole walls forming a communicative elongated groove for receiving connecting lines of the plug-fitted terminals; and a rear-end cap detachably mounted at a rear end of the housing and covering part of the plug-fitting holes.

2. The electrical connector housing assembly according to claim 1, further comprising at least part of the hole walls are thinned for receiving branched connecting lines of the plug-fitted terminals.

3. The electrical connector housing assembly according to claim 1, wherein the rear-end cap covers an outer side of the plug-fitting holes, for fixing and supporting the plug-fitted terminals.

4. The electrical connector housing assembly according to claim 3, wherein an inner side of the rear-end cap is provided with one or more blocks, which abut the plug-fitted terminals, whereby the plug-fitted terminals are blocked from exiting the plug-fitting holes.

5. The electrical connector housing assembly according to claim 3, wherein the rear-end cap is formed with at least one groove, through which the connecting lines of the plug-fitted terminals pass.

6. The electrical connector housing assembly according to claim 1, wherein the rear-end cap comprises a fixing structure for matching a mating fixing structure provided on the housing, so as to fix the rear-end cap onto the housing.

7. The electrical connector housing assembly according to claim 6, further comprising locking legs formed at two ends of the rear-end cap, respectively;

wherein the housing is formed with retaining blocks, which are snap-fitted with the locking legs to prevent the rear-end cap from being detached.

8. The electrical connector housing assembly according to claim 7, further comprising reinforcing ribs formed on an inner side of the locking legs at the two ends of the rear-end cap, for reinforcing the locking legs.

9. The electrical connector housing assembly according to claim 1, wherein the plurality of plug-fitting holes have a same structure for receiving the plug-fitted terminals having same connecting portions.

10. The electrical connector housing assembly according to claim 1, further comprising the plug-fitted terminal, which is adapted to be plug-fitted into the plug-fitting hole.

11. The electrical connector housing assembly according to claim 10, wherein a respective connecting line of the connecting lines has a wide-flat line body.

12. The electrical connector housing assembly according to claim 11, further comprising the respective connecting line has a front end received in the elongated groove.

13. The electrical connector housing assembly according to claim 12, wherein the rear-end cap is formed with at least one groove, and the respective connecting line passes through the locking slot.

14. The electrical connector housing assembly according to claim 11, wherein the respective connecting line is an FFC wire.

15. The electrical connector housing assembly according to claim 11, wherein the connecting line has a cylindrical line body.

16. The electrical connector housing assembly according to claim 10, comprising first and second plug-fitted terminals, wherein the first and second plug-fitted terminals have different connecting lines.

17. The electrical connector housing assembly according to claim 16, comprising first and second plug-fitted terminals, wherein the first and second plug-fitted terminals have identical connection portions.

18. The electrical connector housing assembly according to claim 17, wherein the first and second plug-fitted terminals comprise a first connecting line and a second connecting line, respectively;

the first connecting line has a wide-flat line body and the second connecting line has a cylindrical line body.

19. The electrical connector housing assembly according to claim 18, further comprising the first connecting line has a front end placed in the elongated groove.

20. An electrical connector housing assembly, comprising:

a housing formed with a plurality of plug-fitting holes;

first plug-fitted terminals adapted to be plug-fitted into the plug-fitting holes;

second plug-fitted terminals adapted to be plug-fitted into the plug-fitting holes;

the first and second plug-fitted terminals have identical connection portions, the first plug-fitted terminals having a first connecting line and the second plug-fitted terminals having a second connecting line, the first connecting line having a wide-flat line body and the second connecting line having a cylindrical line body; and a rear-end cap detachably mounted at a rear end of the housing and covering part of the plug-fitting holes.

21. An electrical connector housing assembly, comprising:

a housing formed with a plurality of plug-fitting holes for supporting plug-fitted terminals;

a rear-end cap detachably mounted at a rear end of the housing, the rear-end cap covers an outer side of the plug-fitting holes, for fixing and supporting the plug-fitted terminals, the rear-end cap is formed with at least one groove, through which the connecting lines of the plug-fitted terminals pass.

* * * * *